US007909097B2

(12) United States Patent
Ayasse

(10) Patent No.: US 7,909,097 B2
(45) Date of Patent: Mar. 22, 2011

(54) WELL LINER SEGMENTS FOR IN SITU PETROLEUM UPGRADING AND RECOVERY, AND METHOD OF IN SITU UPGRADING AND RECOVERY

(75) Inventor: Conrad Ayasse, Calgary (CA)

(73) Assignee: Archon Technologies Ltd., Calgary, Alberta (CA)

( * ) Notice: Subject to any disclaimer, the term of this patent is extended or adjusted under 35 U.S.C. 154(b) by 100 days.

(21) Appl. No.: 12/285,980

(22) Filed: Oct. 17, 2008

(65) Prior Publication Data

US 2010/0096120 A1 Apr. 22, 2010

(51) Int. Cl.
*E21B 43/24* (2006.01)
*E21B 43/243* (2006.01)

(52) U.S. Cl. ..... 166/256; 166/50; 166/169; 166/242.6; 166/272.7; 166/371; 166/380

(58) Field of Classification Search ..... 166/272.7, 166/371
See application file for complete search history.

(56) References Cited

U.S. PATENT DOCUMENTS

| | | | | |
|---|---|---|---|---|
| 2,336,168 | A * | 12/1943 | Eckel | 166/246 |
| 3,322,195 | A * | 5/1967 | Brown et al. | 166/300 |
| 3,683,056 | A * | 8/1972 | Brandt et al. | 264/112 |
| 4,537,254 | A * | 8/1985 | Elson et al. | 166/278 |
| 5,083,614 | A * | 1/1992 | Branch | 166/278 |
| 5,355,949 | A * | 10/1994 | Sparlin et al. | 166/236 |
| 5,626,191 | A * | 5/1997 | Greaves et al. | 166/245 |
| 6,412,557 | B1 | 7/2002 | Ayasse et al. | |
| 6,672,385 | B2 | 1/2004 | Kilaas et al. | |
| 6,857,475 | B2 * | 2/2005 | Johnson | 166/278 |
| 7,712,528 | B2 * | 5/2010 | Langdon et al. | 166/272.4 |
| 2008/0083537 | A1 * | 4/2008 | Klassen et al. | 166/302 |
| 2008/0217008 | A1 * | 9/2008 | Langdon et al. | 166/270 |
| 2008/0236819 | A1 | 10/2008 | Foster et al. | |

FOREIGN PATENT DOCUMENTS

| | | | |
|---|---|---|---|
| EP | 0 062 716 | A1 | 10/1982 |
| FR | 2 906 561 | A1 | 4/2008 |

* cited by examiner

*Primary Examiner* — George Suchfield
(74) *Attorney, Agent, or Firm* — Gowling Lafleur Henderson LLP; D. Doak Horne

(57) ABSTRACT

A well liner segment for use in hydrocarbon recovery processes. An elongate, typically cylindrical outer liner member, and an inner elongate liner member concentrically located therewithin is provided. Hydrocarbon upgrading catalyst is provided in the interstitial space between the two members. The outer liner members may be threadably coupled together. A slidable seal is provided between the outer liner and the inner liner to accommodated differential thermal growth between the two liners. A process for use of well liner segments having hydrocarbon upgrader catalyst pre-installed therein, is also provided, as is a method for manufacture of a well liner segment.

16 Claims, 13 Drawing Sheets

WELL LINER SEGMENTS FOR IN SITU PETROLEUM UPGRADING AND RECOVERY, AND METHOD OF IN SITU UPGRADING AND RECOVERY

FIELD OF THE INVENTION

This invention relates to horizontal well liners, and more particularly to well liner segments which permit in situ upgrading of hydrocarbons during recovery from an underground reservoir, a method of manufacture of same, and to a process of in situ upgrading and recovery using such horizontal well segments.

BACKGROUND OF THE INVENTION AND DESCRIPTION OF THE PRIOR ART

Oil upgrader catalyst, such as a standard hydrotreating/HDS catalyst manufactured by Akzo Chemie Nederaland by Amsterdam, and identified as Ketjenfine[1]™ 742-1, 3AQ, has been used in prior art oilfield in situ hydrocarbon upgrading processes of the type described in U.S. Pat. No. 6,412,557.

[1] Trademark of Akzo Chemie Nederaland by Amsterdam for hydrotreating catalyst

Specifically, U.S. Pat. No. 6,412,557 describes a process for upgrading hydrocarbons within a petroleum reservoir by placing such a known hydrotreating catalyst around an exterior periphery of a centrally located perforated pipe situated in the horizontal leg of a horizontal well bore for upgrading and producing oil from a heavy oil (bitumen) formation.

Specifically, as may be understood from the in situ upgrading process of U.S. Pat. No. 6,412,557 and the methodology of the prior art in relation to in situ oil upgrading, a hole is drilled from the surface down to the target reservoir oil zone of the petroleum formation. The hole is curved so that it becomes horizontal when it arrives at the target reservoir oil zone. The horizontal section is typically created near the lowermost base portion of the target reservoir zone, and is extended laterally along the lowermost base portion to create a horizontal well, typically extending for hundreds of meters to the intended toe of the horizontal well. The vertical section of such well is cased. If the reservoir rock is consolidated, the horizontal section may be left open and un-cased, but sometimes a perforated liner is emplaced in the horizontal section to mitigate against the production of sand fines. If the rock is un-consolidated it is imperative to emplace a perforated liner to prevent complete collapse of the hole. Once drilling of the hole is completed a metal pipe is pushed into the hole, typically all the way to the intended toe of the horizontal well. In the horizontal section, this pipe is referred-to as the 'liner'. The liner will have openings that are sized to allow reservoir fluids to enter the interior of the liner for flowing to the surface, but exclude the entry of sand that could plug the liner or cause operational difficulty with oil treating facilities at the surface. The openings in the liner can be narrow slits, in which case the pipe is called a 'slotted liner', or they may be narrow apertures between rows of wire that is wrapped around a pipe having relatively large holes, which are called 'wire-wrapped screens'. Both slotted liners and wire-wrapped screens are commonplace in the design of horizontal wells. The separation of the liner from the undisturbed reservoir is small, typically in the range of 1-2 inches based on a centralized liner. While the bore hole may be drilled larger by reaming operations to leave more space between the liner and the reservoir, this is an additional expense.

As taught in the prior art and for example U.S. Pat. No. 6,412,557, the 1-2 inch annular interstitial space which exists between an un-reamed hole (typically approximately 12.25 inches in diameter) and the outside diameter of the centralized liner (typically of in the range of about 9.6 inches) is filled with catalyst of the type described above or a similar catalyst, by pumping such catalyst downhole into such interstitial space. The catalyst permits upgrading of the oil immediately prior to entering the perforated well liner so as to increase flowability of the produced oil within the horizontal well to more easily produce such oil to surface.

Disadvantageously, however, with this prior art method, since the resulting vertical path of draining fluids (oil) into the perforated liner is very short, the residence time of the oil in the interstitial space which contains such catalyst is very short, and the Gas and Liquid Hourly Space Velocity ("LHSV") will be very high. By way of example, for a well of the above dimensions producing 100 $m^3$/day of produced oil having a well 1-inch annular catalyst zone, the LHSV is approximately 2670 $hr^{-1}$ and the residence time is only approximately 11 seconds. While this short residence time may provide some upgrading, it would be much more desirable to have a catalyst placement design that provides much longer residence times for the oil being exposed to such upgrading catalyst.

Accordingly, a real need exists for a liner design and an improved oilfield in situ hydrocarbon upgrading process which allows increased time of exposure of the produced oil to upgrader catalyst, to thereby improve flowability and increase effective recovery from underground petroleum formations, particularly from bitumen and tar sands formations.

SUMMARY OF THE INVENTION

The present invention relates to horizontal well liner designs which allow increased time or extent of exposure in which produced oil is exposed to upgrader catalyst during in situ hydrocarbon production, as well as improved methods for producing hydrocarbons using in situ hydrocarbon production methods, contemplating use of well liner segments containing catalyst to upgrade oil during production.

Specifically, in a broad embodiment of the present invention, a well liner segment for upgrading hydrocarbons during collection is provided to better allow collection of hydrocarbons from an underground hydrocarbon reservoir. Such liner segment possesses first and second mutually opposite ends and is adapted to be coupled in a horizontal manner at both of said mutually opposite ends to other elongate well liner segments to form an elongate well liner.

Significantly, each well liner segment comprises:

(i) an elongate substantially hollow outer liner member, having a longitudinal axis and possessing a plurality of apertures in at least an upper or lower portion of a periphery thereof, each of a size sufficient to allow flow therethrough of a flowable hydrocarbon;

(ii) an elongate substantially hollow inner liner member, concentrically disposed within an interior of said outer member along said longitudinal axis thereof so as to form an interstitial space between said inner member and said outer member, likewise having a plurality of apertures in an upper and/or lower portion of a periphery thereof to permit ingress of partially upgraded hydrocarbon from said interstitial space to within said inner member;

wherein the interstitial space is adapted to be filled with a catalyst to permit upgrading and improve flowability of said hydrocarbon when the hydrocarbon flows through said interstitial passage and thereafter into the inner liner member via said apertures therein.

In a first embodiment, the well liner segment of the present invention is adapted to permit inward radial flow of the produced oil. Specifically, the apertures in the outer and inner members are located so as to permit the oil to travel radially inwardly through apertures in the outer liner member into the interstitial space where such oil contacts the catalyst, and continue directly radially inwardly or alternatively circumferentially about the inner liner and thereafter radially inwardly through radially-aligned apertures in the inner liner and be collected in the inner liner, where after such upgraded oil may then be pumped or transferred in an appropriate manner to the surface (hereinafter the so-called "radial flow" configuration).

The increase in exposure time to catalyst which results from such horizontal well liner design can be seen mathematically. For example, in the prior art, where as mentioned above, the diameter of an unreamed horizontal well bore outside diameter is typically 12.25 inches and the tubing diameter of prior art (single tube) well liner being in the range of 9.6 inches, accounting for a well liner thickness of ¼ inch, the effective length of travel of oil through catalyst in the outside space between the horizontal well bore and the well liner is only 1.075 inches (ie $[12.25-2\times(0.25)-9.6]/2\}$ and the resulting cross-sectional area of such space $[\pi\times(11.75^2-9.6^2)/4]=36$ sq. inches, assuming the well liner is concentrically located in the well bore.

By way of contrast, for a 9.6 inch diameter circular outer well liner segment of the present invention (ie outer liner member diameter equals 9.6 inches) and an inner member outside diameter of 5.0 inches, assuming a tubing thickness of ¼ inches, the effective radial length of travel of oil through catalyst in the resulting interstitial space between the outer member and the inner member centrally located within such outer member, when the thickness of the steel is accounted for, is increased to 2.0 inches (ie $[9.6-2\times(0.25)-5.0]/2=2.0$) and the resulting cross-sectional area of the interstitial space in which catalyst is placed increases accordingly to: $[\pi(9.6-0.25\times2)^2-5.0^2)/4]=45.4$ sq. inches. If catalyst is also placed in the interstitial space between the horizontal well bore and the outer liner member, the effective radial length of travel of oil is increased to 3.075 inches (ie 1.075+2.0 inches), thus nearly tripling the radial distance which the oil travels through catalyst and thus likewise similarly increasing the time the oil is exposed to catalyst.

In a second alternative embodiment of the well liner of the present invention which likewise serves to increase the amount and time or extent of exposure to catalyst, apertures are situated in the outer liner relative to the inner liner to allow oil at one end of the outer well liner to flow into the interstitial space and thereafter cause such oil to flow laterally along such interstitial space to apertures in the inner liner member located proximate the opposite end of the well liner segment, before permitting the oil to drain or flow into the inner liner member, so as to thereby increase the time and amount of exposure of such oil to catalyst which is packed in such interstitial space (hereinafter the so-called "lateral flow" configuration). The effect of the lateral flow is to greatly increase the residence time of the draining fluids over the catalyst. For example, if the lateral travel length of oil in the interstitial passage between unaligned apertures of the outer and inner liners is 15 inches, the residence time using a lateral flow design of the present invention will be more than ten times as for the radial flow case in the prior art for identical fluid volumetric flow rates having only a effective length of travel of oil through catalyst of only 1,075 inches. While it may seen desirable to make the slotted segments shorter, for longer residence times, this must be balanced with the expected reduction in volumetric fluid production rates since there are fewer slots open to the reservoir on the outer liner.

Accordingly, in such second alternative embodiment of the well liner of the present invention, the apertures in said outer member are situated proximate a first end of mutually opposite ends of the well liner segment, and the apertures in the inner member are situated proximate an opposite second end of the well liner segment. The particular arrangement of such apertures respectively in the inner and outer liner members, namely positioning the apertures in the outer member proximate said first end thereof, allows said hydrocarbon to enter the interstitial space and to thereafter travel longitudinally along the well liner segment and within said interstitial space towards said second end while simultaneously contacting said catalyst therein so as to be upgraded, and to thereafter pass into said inner member via apertures in said inner member proximate said second end so as to become collected in said inner member of said well liner segment.

Alternatively, a configuration of apertures may be used which combines both a "lateral flow" configuration and a "radial flow" configuration.

In a preferred embodiment, at one end of the well liner segment the outer liner is affixed to the inner liner, and at another end the outer liner is in a slidable relationship to the inner liner (as more fully described below in various contemplated configurations) so as to allow some longitudinal movement of the inner liner member relative to the outer liner member in order to prevent buckling or overstressing of either the outer or inner liner members due to differential thermal expansion of the inner liner relative to the outer liner, which may otherwise arise in in situ production methods where well liner segments of the present invention are used.

Thus in one preferred embodiment, the inner well liner is centrally located in the outer well liner by means of an annular ring at one end, welded to the exterior of the inner well liner and to the interior of the outer well liner. At an opposite end the inner liner is concentrically located within the outer liner by two concentric rings, a first ring welded to the interior of the outer liner, and a second ring mounted to the exterior of the inner liner, which concentric ring arrangement permits thermal growth expansion of the inner liner relative to the outer liner, should uneven heating of the inner and outer liner members occur during use. The annular ring, and the concentric rings both also serve to maintain catalyst within the interstitial area between the inner and outer liners.

In an alternative configuration, there is provided means for slidably coupling the inner liner member to the outer liner member at a corresponding end of each of the inner and outer liner member, to prevent the inner liner member from being displaced from within the outer liner member, but simultaneously allowing some slidabie longitudinal movement at one end of the inner liner relative to the outer liner. More particularly, means slidably coupling said inner liner member to said outer liner member at one end is provided, which comprises a first ring member fixedly attached to said outer liner member, which further contacts said inner liner member in slidable engagement therewith so as to permit longitudinal slidable movement of said inner liner member relative to the outer liner member. Alternatively, the means coupling said inner liner member to said outer liner member comprises a first ring member fixedly attached to said inner liner member, which contacts said outer liner member in slidable engagement therewith so as to permit longitudinal slidable movement of said inner liner member relative to the outer liner member.

Still further alternatively, in a preferred embodiment, the means coupling said inner liner member to said outer liner member comprises a first and second pair of ring members situated proximate one end of said well liner segment, said first ring member fixedly coupled to said inner liner member, said second ring member fixedly coupled to said outer liner member, wherein each of said first and second ring members co-operate in a mutual slidable engagement relationship so as to permit longitudinal movement of associated inner and outer liner members relative to each other.

In a further aspect of the present invention, the invention comprises an improved in situ process for upgrading hydrocarbons when collecting said hydrocarbons from an underground hydrocarbon reservoir.

Such improved in situ process of the present invention comprises the steps of:

(i) providing at least one production well having a substantially horizontal leg and a substantially vertical production well connected thereto, wherein the substantially horizontal leg has a heel portion in the vicinity of its connection to the vertical production well and a toe portion at the opposite end of the horizontal leg, said horizontal leg of said production well being situated in a lower part of said hydrocarbon reservoir;

(ii) providing at least one injection well for injecting an oxidizing gas into said hydrocarbon reservoir;

(iii) coupling together a plurality of elongate well liner segments, each fluidly coupled together so as to form a horizontal well liner within said horizontal leg, each of said well liner members comprising:

(a) an elongate substantially hollow outer member, having a longitudinal axis and possessing a plurality of apertures in an upper portion of a periphery thereof, each of a size sufficient to allow flow therethrough of a flowable hydrocarbon;

(b) an elongate substantially hollow inner member, concentrically disposed within an interior of said outer member along said longitudinal axis thereof so as to form an interstitial space between said inner member and said outer member, likewise having a plurality of apertures in an upper portion of a periphery thereof to permit ingress of partially upgraded hydrocarbon from said interstitial space to within said inner member;

(c) said interstitial space filled with a catalyst to upgrade and improve flowability of said hydrocarbon when said hydrocarbon flows through said interstitial passage and thereafter into said inner member via said apertures therein;

(iv) injecting an oxidizing gas through the injection well to conduct in situ combustion, so that combustion gases are produced so as to cause the combustion gases to progressively advance as a front, substantially perpendicular to the horizontal leg, in the direction from the toe portion to the heel portion of the horizontal leg, and fluids drain into the horizontal well liner within said horizontal leg and into said interstial space filled with catalyst and to contact said catalyst and thereby become upgraded; and (v) recovering said partially upgraded hydrocarbon which flows into said inner liner member of each of said well liner segments within said horizontal well liner.

The catalyst which is provided in the interstitial space is contemplated as comprising a hydrocarbon upgrading catalyst selected from the group of hydrocarbon upgrading catalysts comprising:

(i) pelletized catalysts; and/or (ii) granularized catalysts wherein such catalyst is of a size sufficient to be substantially be prevented from escaping through any of said apertures in said outer or inner members so as to substantially prevent loss of said catalyst once said catalyst is situated in said interstitial space.

In a preferred embodiment, the oil upgrader catalyst is a hydrodesulphurization catalyst, and in a further preferred embodiment is hydrotreating/HDS catalyst manufactured by Akzo Chemie Nederaland by Amsterdam, and identified as Ketjenfine[2]™ 742-1, 3AQ.

[2] Trademark of Akzo Chemie Nederaland by Amsterdam for hydrotreating catalyst

In a further aspect of the present invention, a method of manufacture of a well liner segment having an outer liner and an inner liner located within said outer liner is provided, comprising the steps of:

(i) welding at least one seal ring to at least one of said inner and outer liner member, proximate one end thereof;

(ii) inserting said inner liner within said outer liner; and (iii) inserting catalyst pellets in an interstitial space created between said inner liner and said outer liner.

In a preferred embodiment, such method comprises the further additional step of:

(iv) inserting an annular member between said inner and outer liners at an end of each opposite said seal ring, so as to thereby encapsulate said catalyst pellets within said interstitial space between said seal ring and said annular member.

BRIEF DESCRIPTION OF THE DRAWINGS

Further advantages and permutations will appear from the following detailed description of various non-limiting embodiments of the invention, taken together with the accompanying drawings, in which.

DETAILED DESCRIPTION OF PREFERRED EMBODIMENTS

Figure 1:
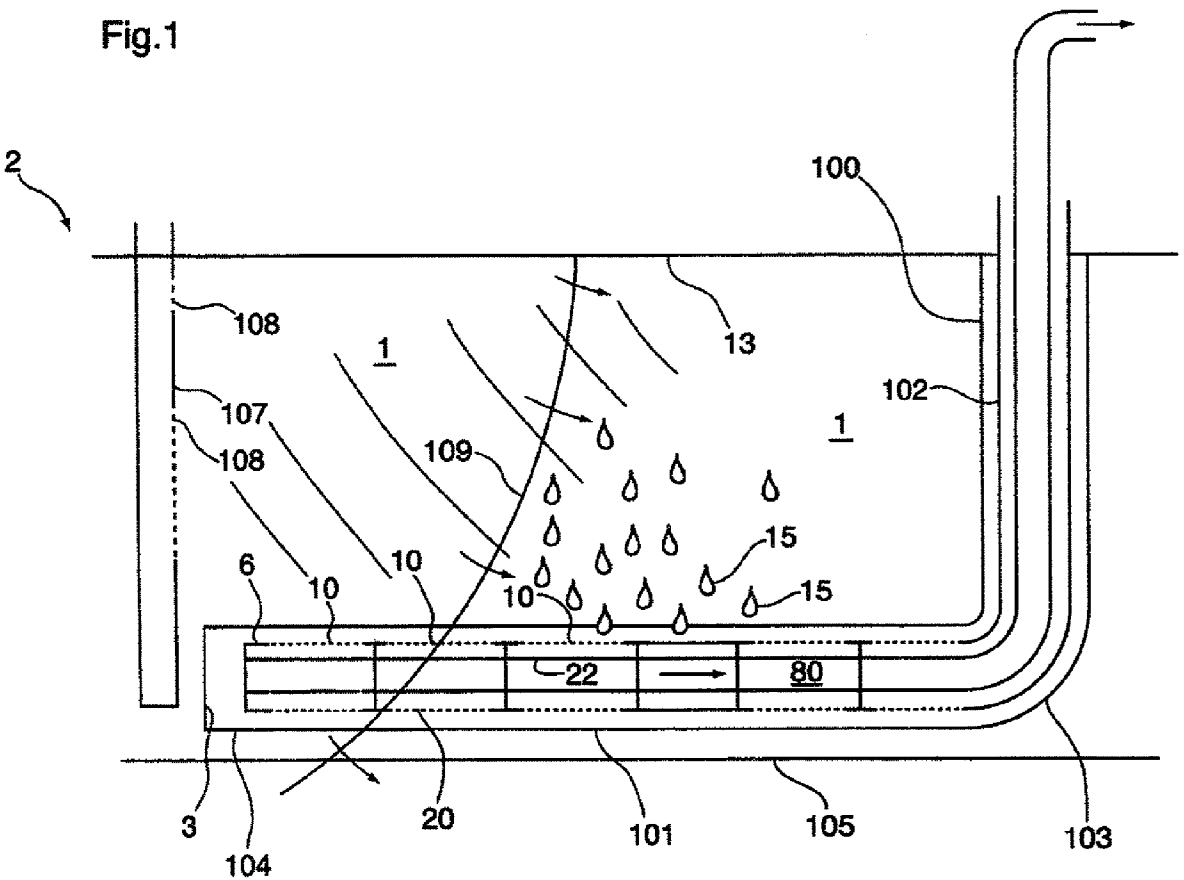
FIG. 1 is a schematic view of a catalytic petroleum upgrading system utilizing the well liner segments of the present invention employed in an in situ petroleum extraction application.

FIG. 1 shows a schematic diagram of an in situ hydrocarbon recovery system 2, for improved recovery of hydrocarbons from a hydrocarbon-bearing formation 1, utilizing a plurality of elongate well liner segments 10 of the present invention within the horizontal well bore 3 thereof.

Such hydrocarbon recovery system 2 is adapted to direct hydrocarbons, particularly viscous oil 15 which, during the method of such hydrocarbon recovery system 2, drains out of hydrocarbon formation 1, through a catalyst-packed interstitial space 12 within each well liner segment 10, for subsequent recovery to surface 13.

A plurality of well liner segments 10 of the present invention are shown, each threadably coupled to an adjoining other well liner segments 10 so as to form a well liner 6 as shown in FIG. 1 for use in in situ hydrocarbon recovery methods.

In operation, oil 15 which is heated by means of in situ combustion methods or alternatively steam assisted gravity drainage (SAGD) and which flows from such hydrocarbon-bearing formation 1 is upgraded during passage into the well liner segments 10 of the present invention, and is thereafter more easily flowed within the well liner 6 and thereafter produced to the surface 13 of the well.

With reference to FIGS. 1-13 herein, the well liner segments 10 each comprise a slotted or wire-wrapped outer liner member 20, typically of approximately 9.6 inches outer diameter. Such outer liner member 20 is in contact (particularly along the bottom portion of the exterior periphery thereof) with the inner diameter of an un-reamed horizontal well bore 3 as shown in FIG. 1, the latter being typically of approximately 12.2 inches in diameter, so that an interstitial space 24 may be formed between outer well liner 20 and the horizontal well bore 3.

A slotted or wire-wrapped inner liner member 22 is provided, concentrically located within outer liner member 20 to form the interstitial space 12, such inner liner member 22 having an inner volume/area 80 for collecting upgraded hydrocarbon and allowing it to be transferred to surface 13 by pumping or other transfer method.

Figure 4B:
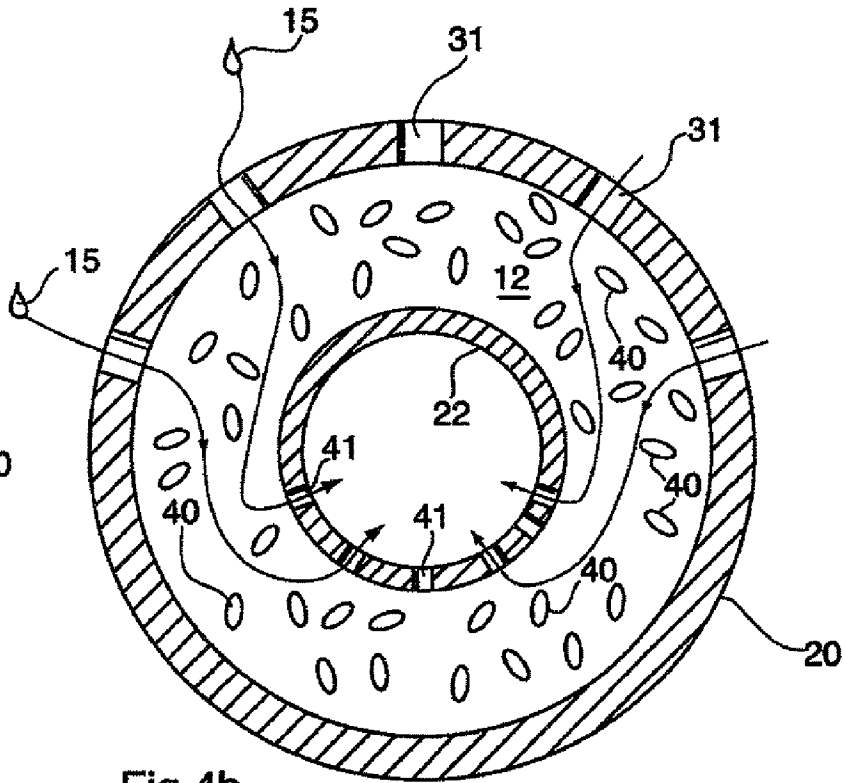
FIG. 4*b* is a cross-section of a well liner segment of the present similar view to that shown in FIG. 4*b*, showing a modification to the alignment of apertures in each of the outer well liner and inner well liner, so as to provide more radial flow and exposure to catalyst in the interstitial area between the outer and inner well liner.

In a preferred embodiment, each of outer liner member 20 and inner liner member 22 of the well liner segment 10 are cylindrical elongate members, adapted to be inserted in a cylindrical horizontal well bore 3 as shown in FIG. 1. Interstitial space 12 formed between the inner diameter of the outer liner 20 and the outer diameter of the inner well liner member 22 is accordingly an annular interstitial space 12, as best shown in FIGS. 4*a* and 4*b*.

Figure 2:
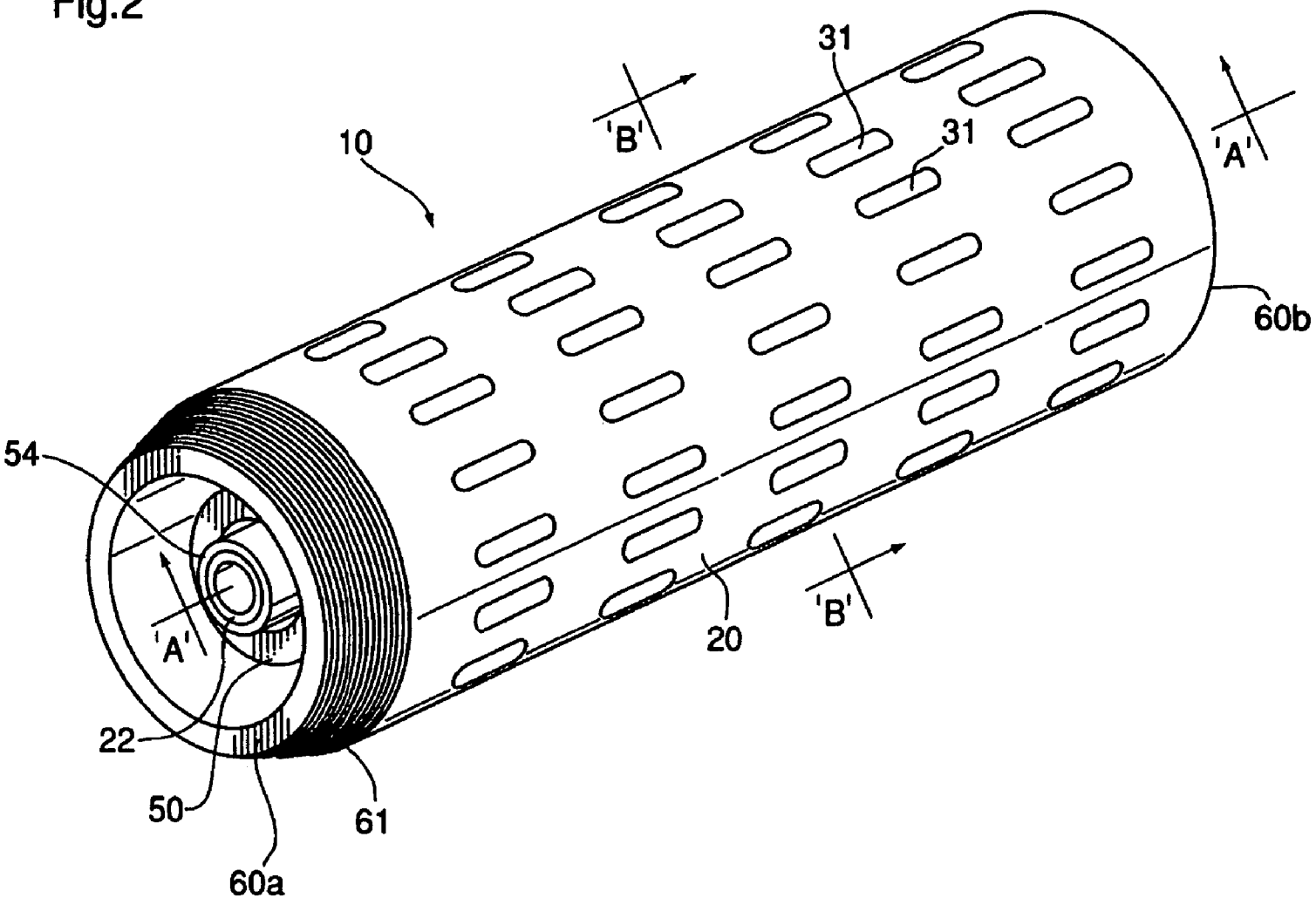
FIG. 2 is a perspective view of the exterior of a well liner segment of the present invention.
Figure 5:
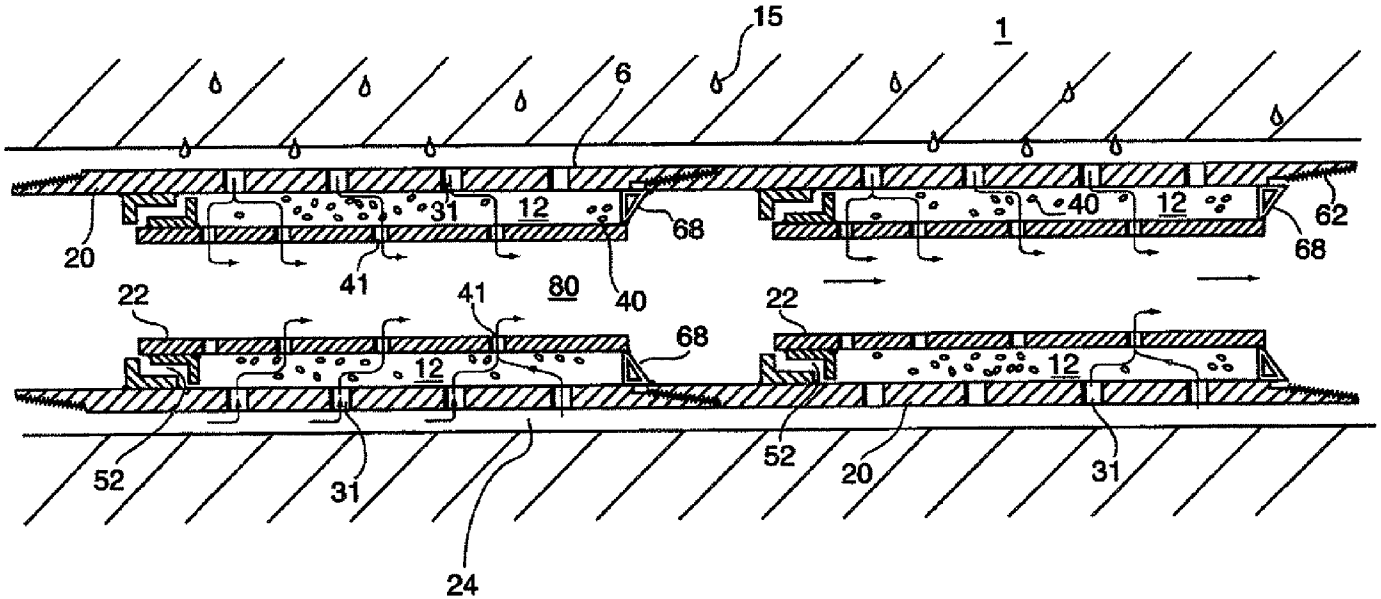
FIG. 5 is a cross-sectional view of a pair of fluidly coupled well liner segments as shown in FIG. 3, showing the manner of interconnection of such pair of well liner segments together and showing the manner by which oil is directed through catalyst contained in an interstitial space for the so-called radial-flow configuration.
Figure 7:
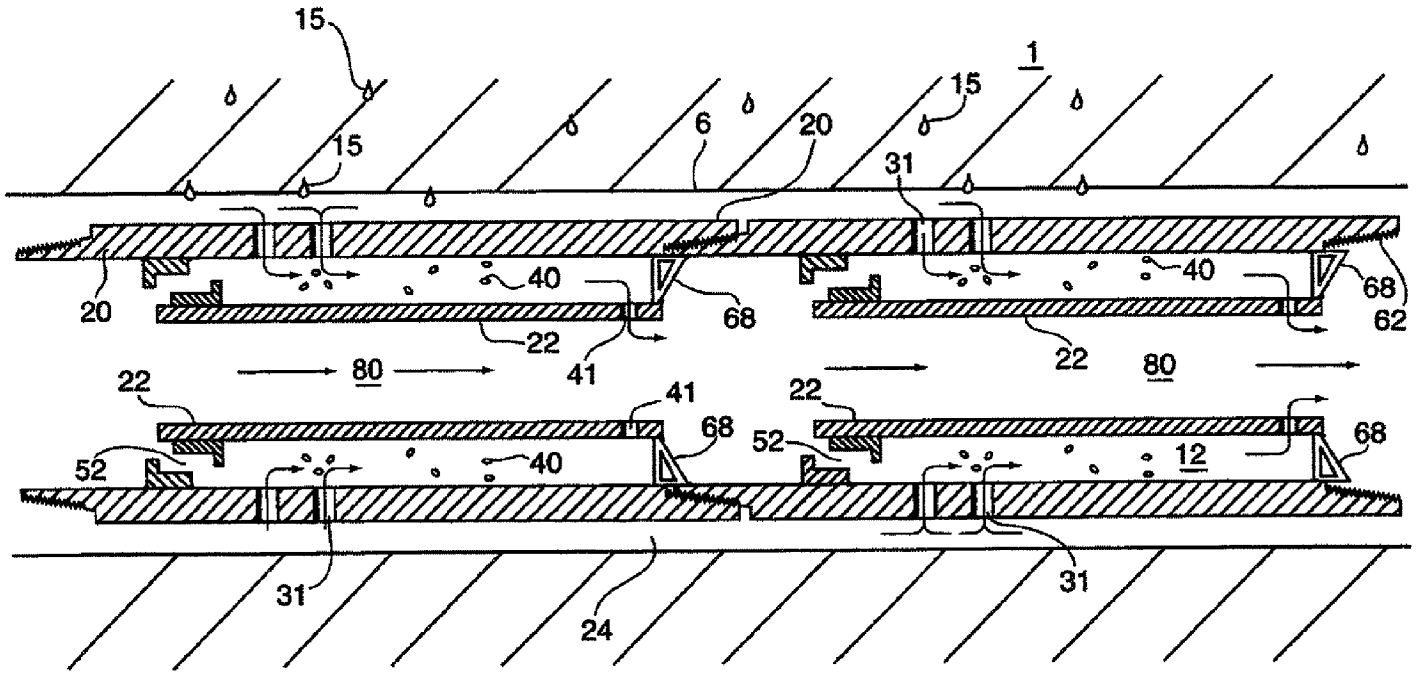
FIG. 7 is a cross-sectional view of a pair of fluidly coupled well liner segment of shown in FIG. 6, showing the manner of interconnection of such pair of well liner segments together and showing the manner by which oil is directed through catalyst contained in an interstitial space for the so-called lateral flow configuration.
Figure 9:
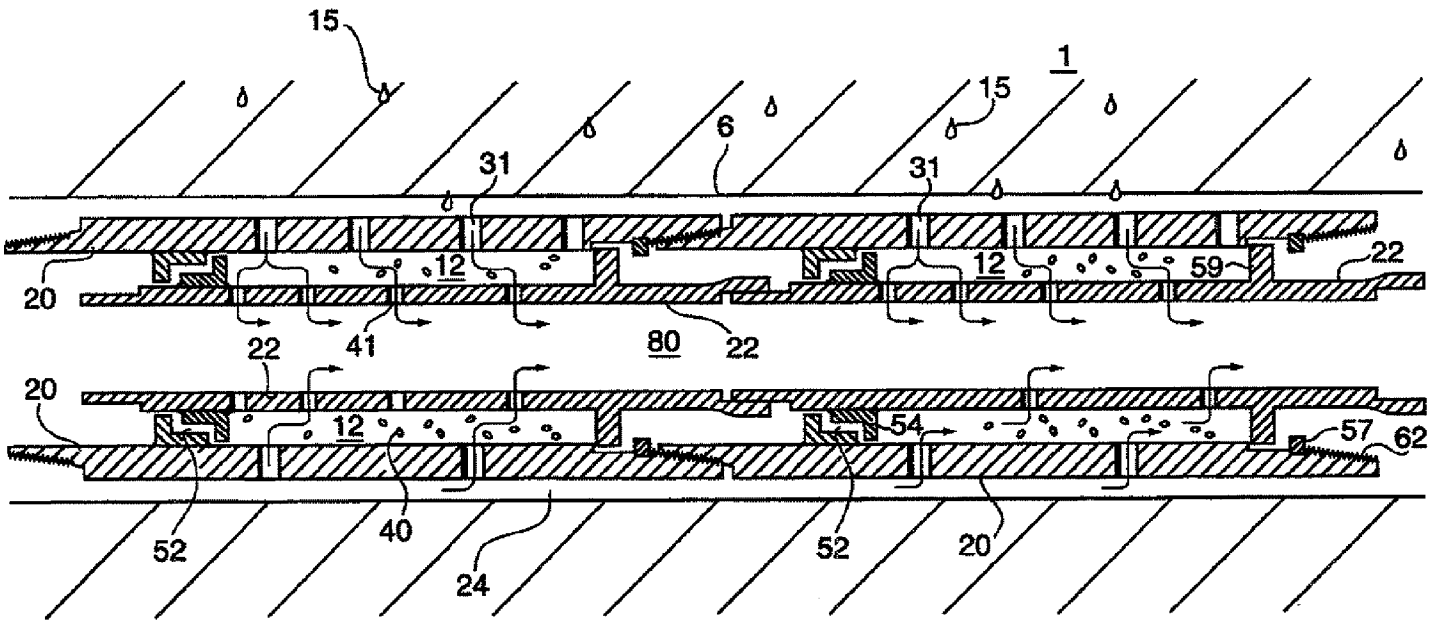
FIG. 9 is a cross-sectional view of a pair of fluidly coupled well liner segments as shown in FIG. 8, showing the manner of interconnection of such pair of well liner segments together and showing the manner by which oil is directed through catalyst contained in an interstitial space for the so-called radial-flow configuration.

FIG. 2 shows a perspective view of a preferred embodiment of a well liner segment 10 of the present invention, having at a first end 60*a* thereof having a male threaded portion 61 thereon (preferably a standard NPT pipe thread) for threaded coupling to an opposite end 60*b* of an adjoining well liner segment 10, such opposite end 60*b* having an internal female threaded portion 62 thereon as shown in FIGS. 5, 7, & 9 herein.

In a preferred embodiment, as best shown in FIG. 2, outer member 20 is a rolled steel of approximately ¼ inch in thickness, and approximately 10 inches in outside diameter. Apertures 31 in outer member 20 comprise a plurality of slots, each having a width less than the width of the granules of catalyst 40 to prevent egress of such catalyst 40 from the interstitial space 12, and sufficiently narrow in width to substantially prevent ingress of sand and other debris such as drill tailings into outer member 20 but of sufficient width to allow ingress of flowable hydrocarbons. Accordingly, the width of such apertures/slots 31 is in the range of 0.005 to 0.025 inches (0.128 to 0.625 mm), and length is typically 6 to 8 inches with approximately 50 of such apertures/slots 31 evenly spaced about a periphery of outer member 20. Of course other spacing and slot lengths may be used, all with a view of maximizing ingress of hydrocarbons and preventing, within reasonable limits, ingress of sand and other debris into outer member 20.

Figure 4A:
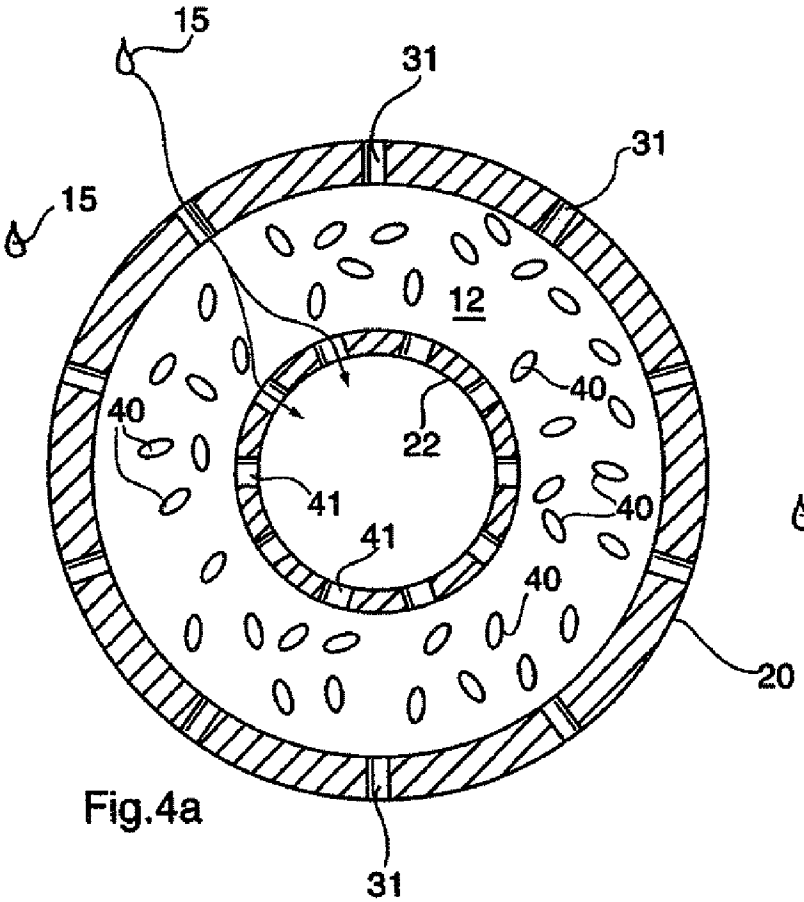
FIG. 4*a* is a cross-sectional view of the well liner segment shown in FIG. 2, taken along plane 'A'-'A' of FIG. 2.

In a first embodiment and as shown in FIGS. 2 & 4*a*, apertures/slots 31 are evenly spaced about a periphery of outer member 22. Similarly, apertures/slots 41 in interior member 22 are likewise equally spaced about an entire periphery thereof. Apertures/slots 41 are typically larger in width than apertures 31, as there is no remaining need to attempt to "screen" sand from the viscous oil 15 entering interior member 22. Viscous oil 15 consequently flows directly radially inwardly through catalyst 40 in interstitial space 12 into interior area 80 in internal member 22, as seen in FIG. 4*a*.

Alternatively, as seen in FIG. 4*b*, apertures/slots 31 in outer member 20 may be situated only on an upper portion of outer member 20, and apertures/slot 41 in inner member 22 situated on a lower portion thereof. A vice versa arrangement is also contemplated. Under either of the two alternative configurations, viscous oil 15, as shown in FIG. 4*b*, will necessarily be required to travel a circumferential distance within interstitial space 12, thereby providing greater exposure time to catalyst 40 within interstitial space 12, thereby improving upgrading of such viscous oil 15.

Figure 3:
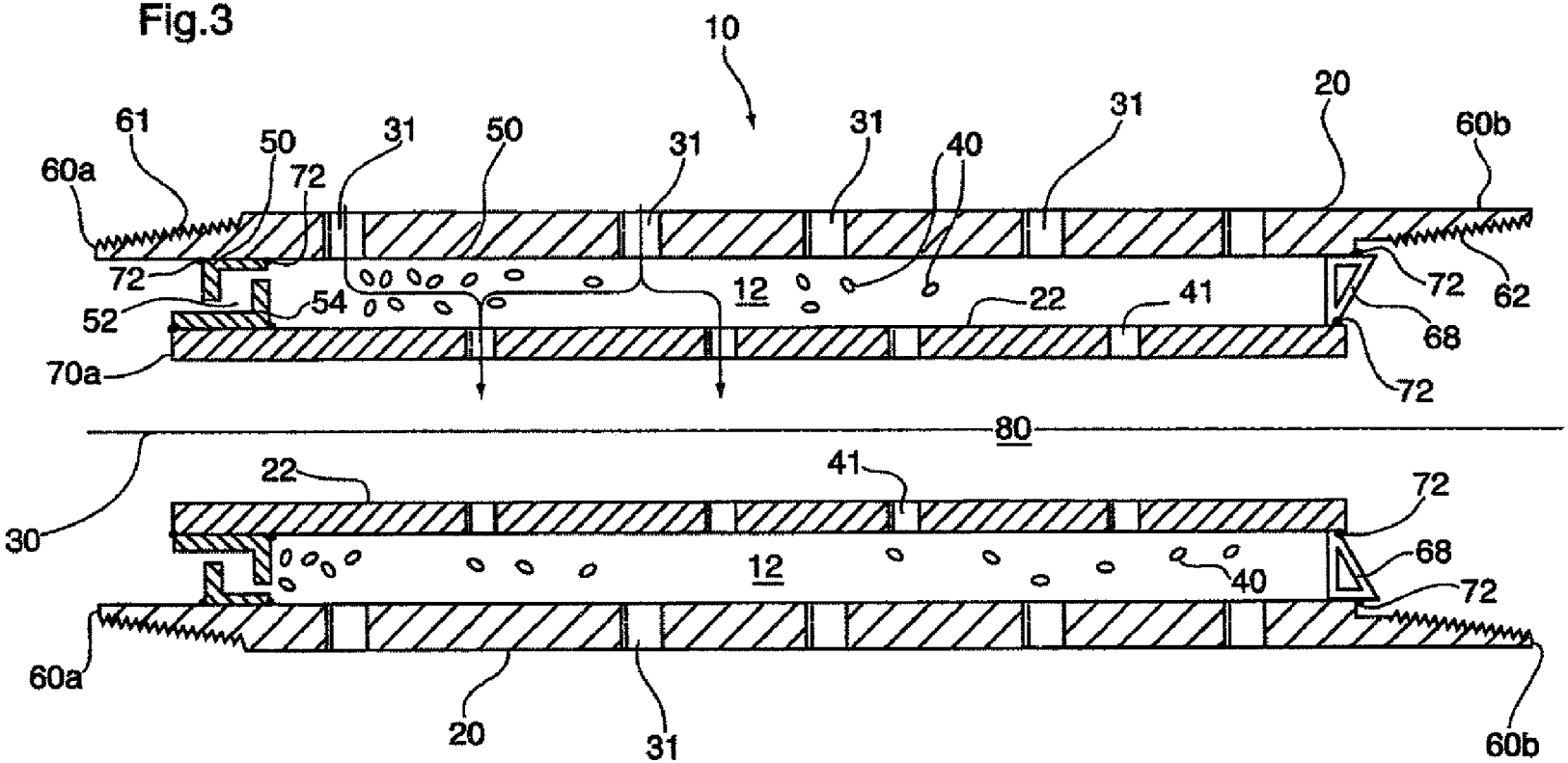
FIG. 3 is a cross-sectional view well taken along plane 'A'-'A' of FIG. 2, showing a first embodiment of the well liner of the present invention, namely a well liner segment of the so-called "radial flow" configuration.

FIG. 3 shows a cross-section through the well liner segment 10 of the present invention, taken along plane A-A of FIG. 2, showing a first embodiment of the well liner segment 10, namely a so-called "radial flow" configuration. FIG. 5 shows a plurality of such well liner segments 10 of the "radial flow" configuration, wherein outer members 20 are each threadably coupled together at opposite ends 60*a*, 60*b* to form horizontal well liner 6. As may be best seen from FIGS. 4*a*, 4*b*, and FIG. 5, in the "radial flow" configuration viscous oil 15 within a hydrocarbon formation 1 flows radially inwardly through apertures/slots 31 in outer member 20, radially inwardly through catalyst 40 packed into interstitial space 12 where such viscous oil 15 is at least partially upgraded, and further progresses radially inwardly though apertures 41 in interior member 22 into interior area 80, whereafter such upgraded oil is transferred to surface 13.

The well liner segment 10 of the "radial-flow" configuration shown in FIGS. 3-5 is adapted to permit flow of oil 15 in a radial direction perpendicular to a longitudinal axis 30 of such well liner 10, as shown from the direction of arrows in FIGS. 3, 4*a*, 4*b*, & 5. As seen from FIGS. 3, 4*a*, & 5, apertures 31 are provided in outer liner member 20, to allow oil 15 to flow into interstitial space 12.

Interstitial space 12 is typically packed during manufacture of such well liner segment 10 with a hydrocarbon upgrader catalyst 40. One such hydrocarbon upgrader catalyst 40 which is suitable for use in the present invention is standard hydrotreating/HDS catalyst manufactured by Akzo Chemie Nederaland by Amsterdam, and identified as Ketjenfine[3]™ 742-1, 3AQ.

[3] Trademark of Akzo Chemie Nederaland by Amsterdam for hydrotreating catalyst consisting of a hydrodesulfurization catalyst containing 4.4 wt. % of CoO and 15 wt. % of MoO3 on γAl2O3

Preferably, hydrocarbon upgrader catalyst 40 when positioned in such interstitial space 12 during manufacture of such well liner segment 10 is of a pelletized or granularized form, of a size nominally greater than the size of apertures 31, to prevent loss of catalyst from interstitial space 12 via apertures 31.

Figure 6:
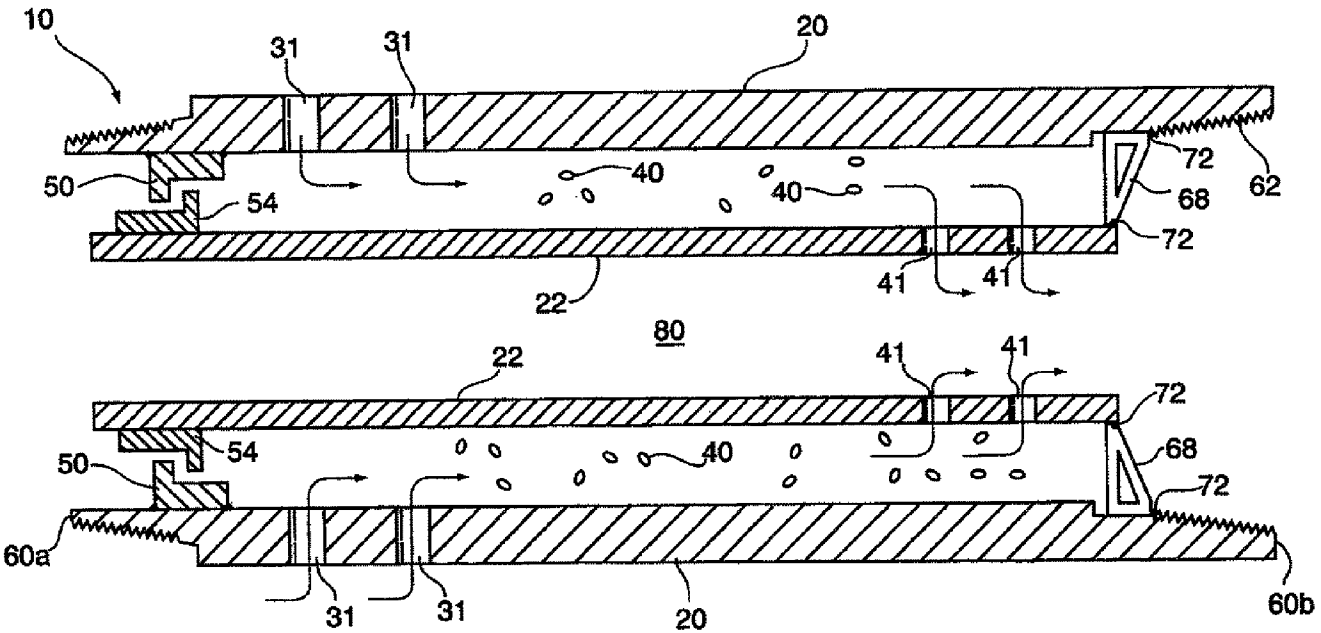
FIG. 6 is a cross-sectional view of an alternative embodiment of the well liner of the present invention, namely a well liner segment of the so-called "lateral flow" configuration.

FIG. 6 shows an alternative configuration of the well liner segment 10 of the present invention, adapted to permit lateral flow of oil 15 within interstitial space 12 so as to increase the extent and duration which oil 15 contacts upgrader catalyst 40. Such alternative well liner segment configuration is hereinafter referred to as the "lateral flow" configuration. FIG. 7 shows a plurality of well liner segments 10 of the "lateral flow" configuration threadably coupled together at mutually opposite ends 60*a*, 60*b*, to form a well liner 6. As best seen from arrows shown on FIGS. 1 & 7, viscous oil 15 from formation 1, during a hydrocarbon recovery method such as in situ combustion process as described in U.S. Pat. No. 6,412,557 or US publication No. 20080066907 published Mar. 20, 2008 and similarly assigned to a common owner, drains from formation 1 flows into apertures/slots 31 on outer members 20 proximate end 60*a* thereof, and into interstitial space 12. Thereafter oil 15 flows laterally within such interstitial space 12 in the direction of the arrows shown, until, at an opposite end 60*b* of well liner segment 10, apertures 41 in inner well liner 22 are reached, wherein oil 15 flows into the interior 80 of inner member 22, and thereafter is transferred, generally by way of pumping, to surface 13. This process is adapted to be repeated for in each well liner segment of the present invention when a plurality of well liner segments 10 are inserted in a horizontal well bore 3.

In both the "radial flow" and "lateral flow" embodiments of the well liner 10 of the present invention, and as best shown in FIGS. 3 & 5, and FIGS. 6 & 7 respectively, interior members 22 may be concentrically located within, and affixed to, outer members 20 at one end 60*b* thereof via a conical ring member 68, which is affixed to each of outer and interior members 22, 22 via circumferential welds 72. As further explained below, not only does conical ring member 68 serve to concentrically locate and affix interior member 22 to outer member 20 at one end thereof, such conical ring member 68 serves to retain catalyst 40 within interstitial space 12.

Likewise, at an opposite end 60*a* of the well liner segment 10 of the present invention, in both the "radial flow" and "lateral flow" embodiments thereof, and as best seen for example in FIGS. 3 & 5, and FIGS. 6 & 7 respectively, a sliding seal 52 is preferably provided at such opposite end 60*a*. The purpose of the sliding seal 52 is to allow for differential thermal growth between the inner member 22 and the outer member 20. This sliding seal 52 may be of a number of forms and configurations, as will necessarily now be apparent to a person of skill in the art.

In a first embodiment, as shown in FIGS. 3 & 5-11, such sliding seal 52 comprises a first (outer) ring member 50 fixedly secured via circumferential welds 72 to outer member 20, and a second (inner) ring member 54 likewise secured via circumferential welds to inner member 22, which ring members 50, 54 together act to concentrically locate inner liner member 22 within outer member 20.

Figure 12:
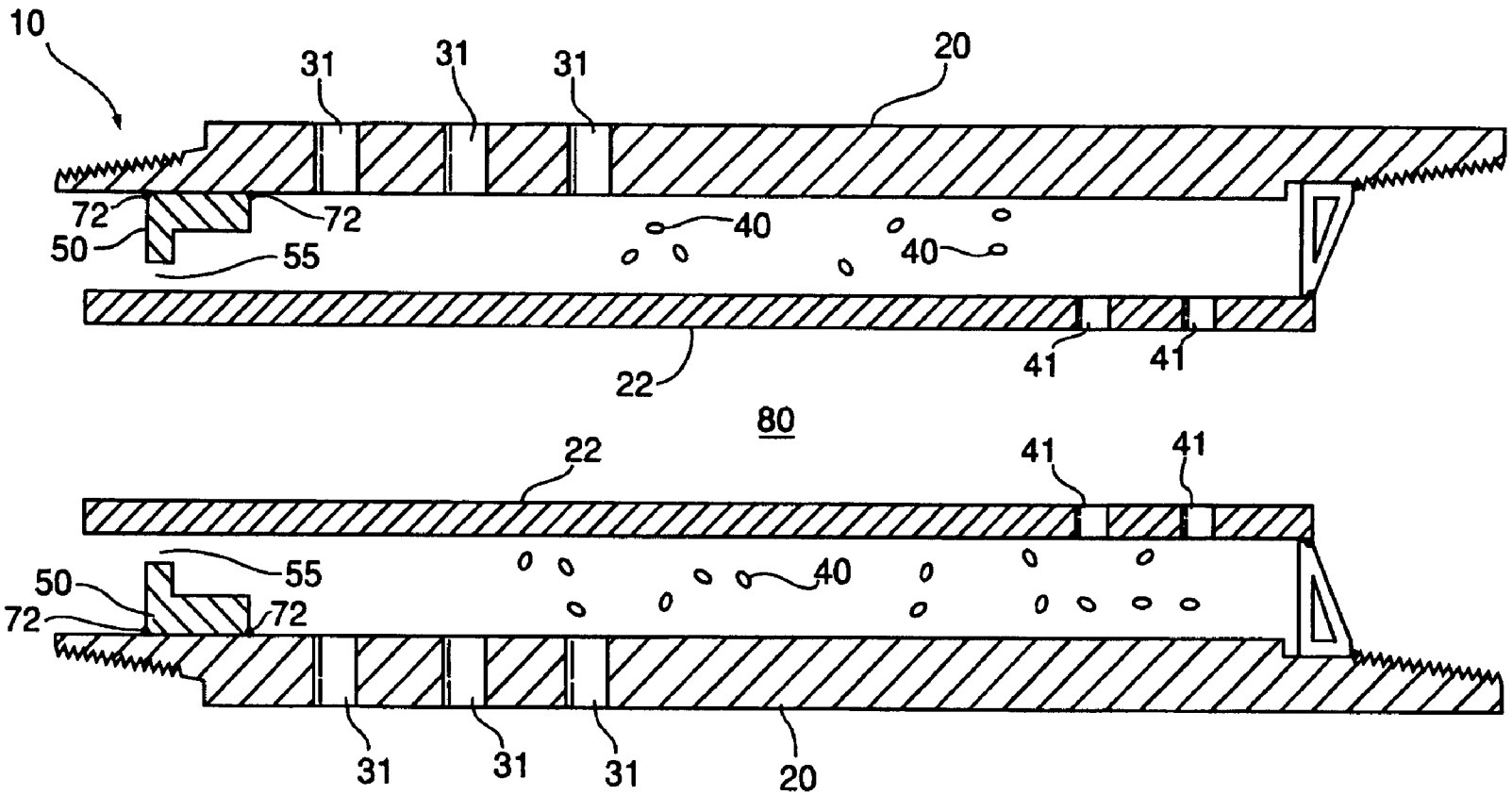
FIG. 12 is a cross-sectional view of a so-called "lateral-flow" well liner, but in comparison to the embodiment shown in FIG. 10 shows a variation in the manner by which the inner well liner may be concentrically located within the outer liner member by use of a seal ring.

In a second embodiment, a first version of which is shown in FIG. 12, the sliding seal 52 comprises merely a single (outer) ring member 50 fixedly secured to said outer member 20, as shown in FIG. 12, to allow not only longitudinal expansion of said inner liner member 22 to said outer liner member 20, but also provide some clearance 55 to permit some radial growth due to thermal expansion in a radial direction. In a second version, shown in FIG. 13, the sliding seal 52 comprises merely a single (inner) ring member 54 fixedly secured to the inner liner member 22 via circumferential welds 72, to allow not only longitudinal expansion/contraction of said inner liner member 22 relative to said outer liner member 20, but also provide some radial clearance 55 to permit some radial growth. Importantly, in all configurations the sliding seal 52 not only concentrically locates inner liner member 22 within outer liner member 20, but also simultaneously allows slidable longitudinal movement of inner liner 22 relative to outer liner member 20 to accommodate differential thermal expansion of outer liner 20 to inner liner member 22 which occurs during methods which employ heat in the collection of oil from hydrocarbon reservoirs of the type contemplated herein, including use in in situ hydrocarbon extraction recovery methods.

Figure 8:
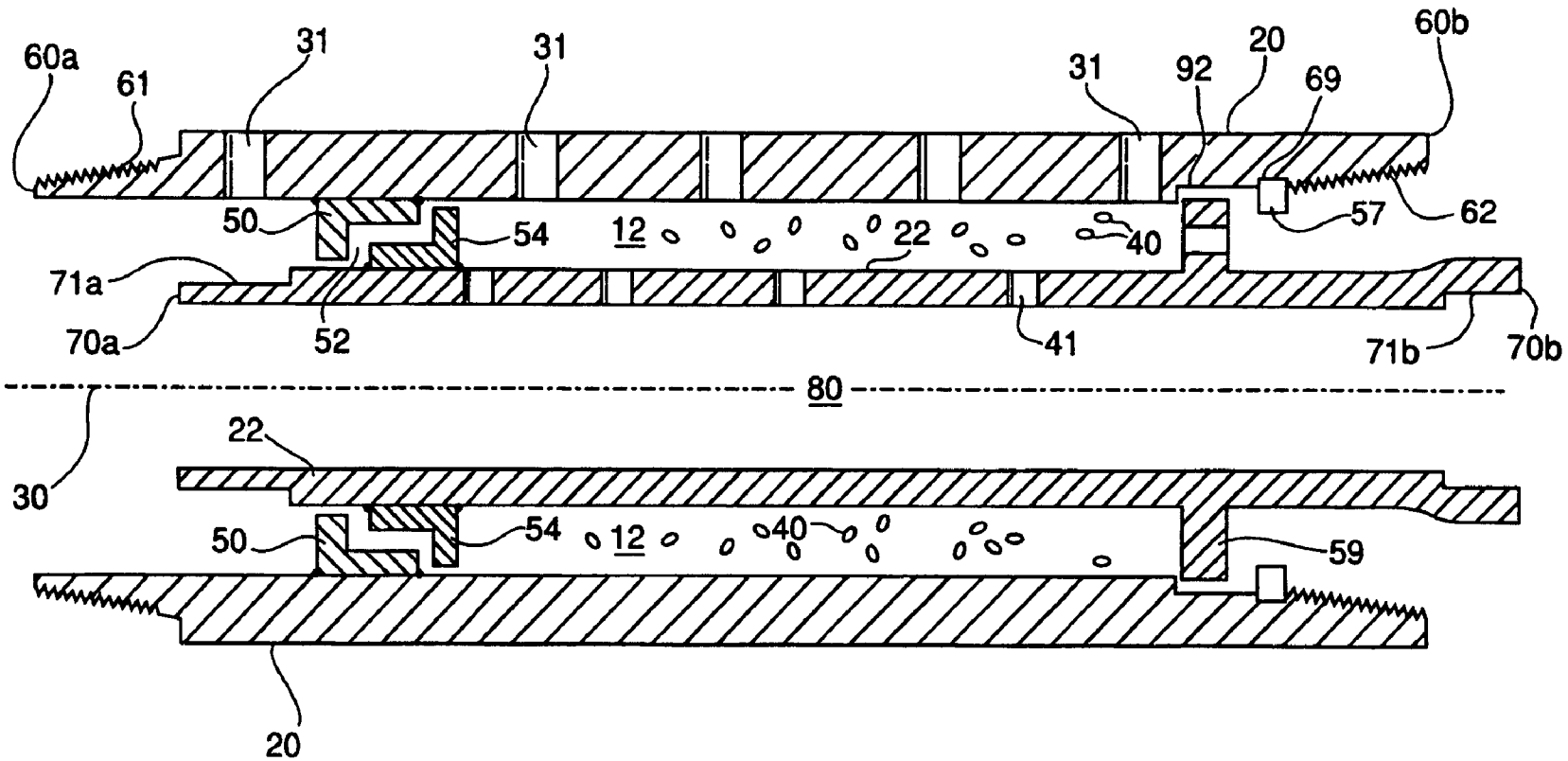
FIG. 8 is a cross-sectional view of a well liner segment of the so-called "radial-flow" configuration, wherein in the embodiment shown a particular means is provided at opposite ends of the interior well liner to allow direct fluid coupling of one interior well liner to another.

In the embodiments shown in FIGS. 3 & 5-7, and as noted above, a conical ring member 68 may be affixed to each of outer and interior members 20, 22 via circumferential welds 72, to concentrically locate and affix interior member 22 to outer member 20 and to further retain catalyst 40 within interstitial space 12. Alternatively, and as best seen in FIGS. 8-11, an annular retainer member 59 may instead be provided on inner liner member 22, adapted to abut an annular shoulder 92 on outer liner member 20. A lock ring 57 may be further provided so as to secure and retain retainer member 59 and associated inner liner 22 within outer liner member 20. Lock ring 57 possesses external threads 69 to allow it to be threadably received on (internally threaded) end 60*b* of outer member 20, as best seen in FIG. 8. Alternatively, lock ring 57 may be dispensed with, and inner liner member 22 secured within outer liner member 20 by one of the ends 60*b* thereof when another well liner segment 10 is threadably secured together, as shown in FIG. 11. However, in this embodiment, use of such externally threaded lock ring 57 is preferred, as such is useful to prevent inadvertent removal of such inner liner member 22 from said outer liner member 20 during shipping or transport of individual well liner segments 10.

Preferably in all embodiments of the well liner segments 10 of the present invention, each of mutually opposite ends 60*a*, 60*b* of outer well liner 20 possess male external threaded end 61 and female (internal) threaded end 62 respectively, to permit threadable connection of respective ends 60*a* and 60*b* of separate well liner segments 10 together, as shown in FIGS. 3, 5, 7, 9, & 11, so as to form a continuous well liner 6 in which to produce oil 15 to surface 13.

In another embodiment of the invention, provision may be made for the inner liner members 22 to be coupled together, as shown in FIGS. 8-11. In a first version of this alternative embodiment, as shown in FIGS. 8 & 9, each of mutually opposite ends 70*a*, 70*b* on each of inner liner member 22 may possess male and female unthreaded ends 71*a*, 71*b*, respectively, which may be insertable one within an other as shown in FIG. 9, to allow fluid coupling of inner liner members together at the time of threadable coupling together of mutually opposite ends 60*a* and 60*b* on each outer member 20.

Figure 10:
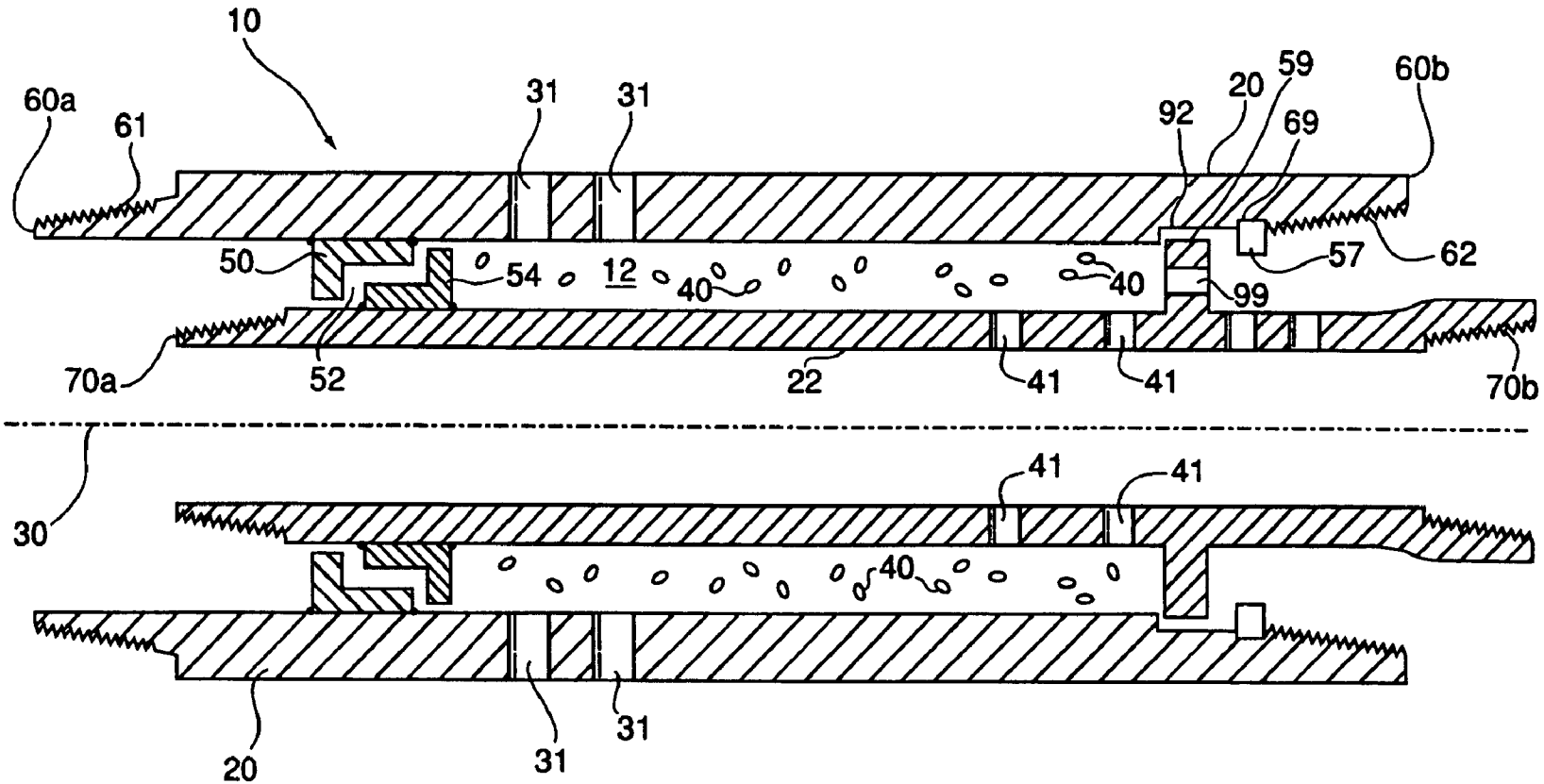
FIG. 10 is a cross-sectional view of a well liner segment of the so-called "lateral-flow" configuration, wherein in the embodiment shown another means is provided at opposite ends of the interior well liner to allow direct fluid coupling of one interior well liner to another.
Figure 11:
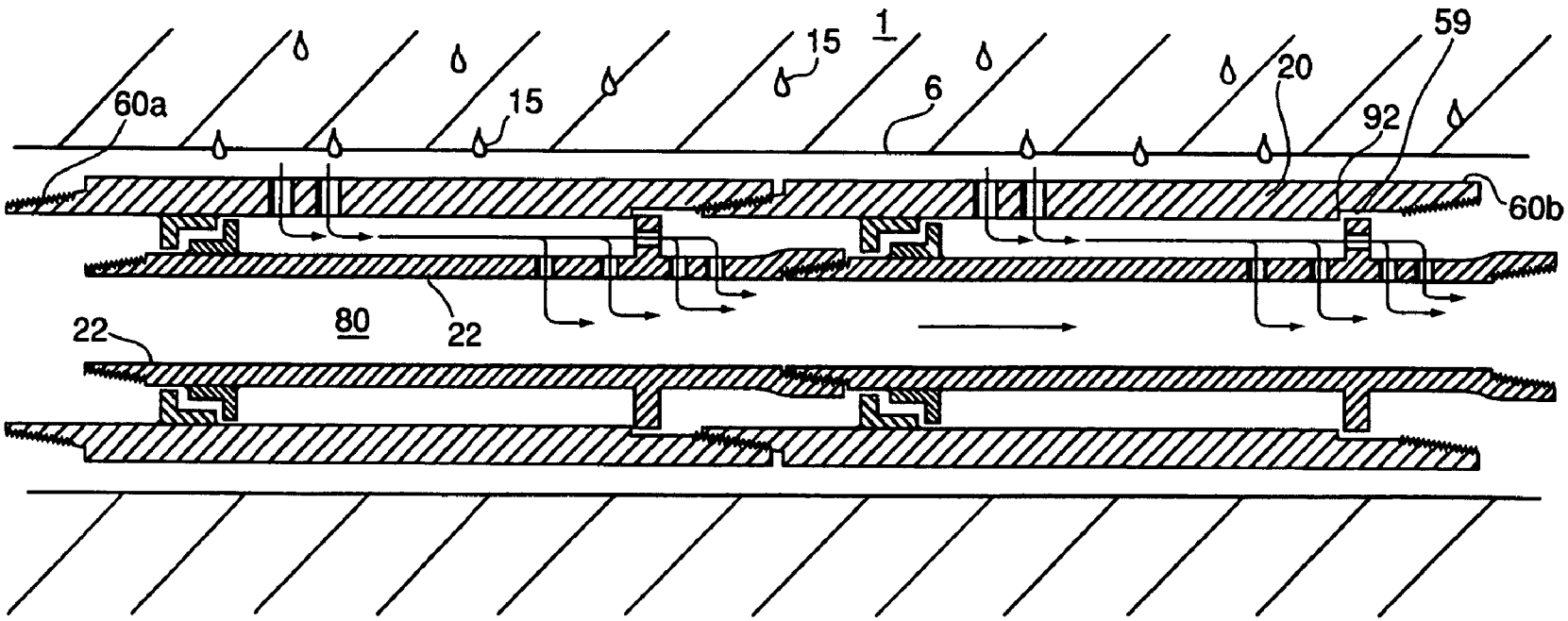
FIG. 11 is a cross-sectional view of a pair of fluidly coupled well liner segments as shown in FIG. 10, showing the manner of interconnection of such pair of well liner segments together and showing the manner by which oil is directed through catalyst contained in an interstitial space for the so-called lateral-flow configuration.

In a still further refinement, and as shown in FIGS. 10 & 11, each of mutually opposite ends 70*a*, 70*b* on each inner liner member 22 may possess male 71*a* and female threaded ends 71*b* respectively, which permit threadable connection of mutually opposite ends 70*a*, 70*b* when mutually opposite ends 60*a*, 60 on each outer liner 20 are threadably connected. Such threaded opposite ends 60*a*, 60*b* and 70*a*, 70*b* are each typically a national pipe thread (NPT) configuration of the type commonly used for threaded pipe in the oil industry.

Other means of fluidly coupling well liner segments 10 together will now be clearly apparent to those of skill in the art, and are further contemplated within the scope of this invention as being other equally viable alternative means of fluidly coupling well liner segments 10 together.

For a horizontal well liner 10 of 414 meters, 69 connected well liner segments 10 each of 6-meter length are required. For an annular interstitial space of 1.5 inches, each well liner segment 10 will contain approximately 300 pounds of catalyst 40.

The following is a description of how oil 15 is able to be collected and upgraded and thereafter pumped to surface 13 using the well liner segments 10 of the present invention in an in-situ hydrocarbon recovery system 2.

Specifically, in an in situ hydrocarbon recovery process 2 as may be seen from FIG. 1, at least one production well 100 is drilled, having a substantially horizontal leg 101 and a substantially vertical production well 102 connected thereto, using horizontal and/or directional drilling techniques which are widely known and used in the art of horizontal drilling. The substantially horizontal leg 101 has a heel portion 103 in the vicinity of its connection to the vertical production well 102 and a toe portion 104 at the opposite end of the horizontal leg 101, said horizontal leg 101 of said production well 100 being situated in a lower part 105 of a hydrocarbon reservoir 1. An injection well 107 is provided, for injecting an oxidizing gas into an upper part of reservoir 1.

A plurality of elongate well liner segments 10 are coupled together via coupling means comprising exterior male 61 threaded portions and female threaded portions on respective ends 60*a*, 60*b* of outer well liners 20, and inserted through horizontal well bore 3 so as to form a horizontal well liner 6 within said horizontal leg 101, as shown in FIGS. 3, 5, 7, and 9. Each of said well liner segments 10 comprise:

(a) an elongate substantially hollow outer member 20, having a longitudinal axis 30 and possessing a plurality of apertures 31 in at least an upper portion of a periphery thereof, each of a size sufficient to allow flow therethrough of a flowable hydrocarbon into an interior of said outer member;

(b) an elongate substantially hollow inner member 22, concentrically disposed within an interior of said outer member 20 along said axis 30 thereof so as to form an interstitial space 12 between said inner member 22 and said outer member 20, likewise having a plurality of apertures 41 on a portion of a periphery thereof to permit ingress of partially upgraded hydrocarbon 2 from said interstitial space 12 to within said inner member 22;

(c) said interstitial space 12 filled with a catalyst 40 to upgrade and improve flowability of said hydrocarbon when said hydrocarbon flows through said interstitial passage 12 and thereafter into said inner member 22 via said apertures 41 therein.

In the in situ extraction process as shown in FIG. 1 utilizing the well liner segments of the present invention, oxidizing gas, such as air or oxygen, is injected through the injection well 107 and enters the formation through perforations 108 in well 107. A source of ignition (not shown) is provided to cause in situ combustion. Alternatively, ignition may be spontaneous following heating of the oil near the injector well 107. Upon ignition of the oil, combustion gases are produced which progressively advance as a combustion front 109, substantially perpendicular to the horizontal leg 101, in the direction from the toe portion 104 to the heel portion 105 of the horizontal leg 101, and fluids drain into the horizontal well liner 6 within said horizontal leg 101 and into said interstitial space 12 filled with catalyst 40 and to contact said catalyst 40 and thereby become upgraded. The upgraded and heated petroleum drain by gravity and pressure differential into the horizontal leg 101, namely the interstitial space 12 where such oil 15 is upgraded by coming into contact with catalyst 40, and thereafter enters inner liner member 22, and in particular inner volume area 80 thereof, where such oil is thereafter pumped to surface 13.

A method for the manufacture of well liner segments 10 of the present invention is set out below.

For the embodiments of the well liner segments 10 shown in FIGS. 3, 5, and 6-7, seal rings 50 and 54 are first circumferentially welded to outer and inner well liner members 20, 22 respectively. Inner well liner 22 is then inserted within outer well liner 20, typically each being aligned in a vertical position, so that seal rings 50, 54 are positioned as shown in the FIGS. 3, 5, and 6-7. Temporary spacers means (not shown) may be temporarily positioned about a periphery of inner member 22 at end 70*b* thereof so as to concentrically locate inner member 22 within outer member 20.

Catalyst pellets 40 are then dropped into the interstitial space 12, so as to fill such space 12 with catalyst 40. Thereafter, the temporary spacers are removed, and conical ring member 68 is inserted and circumferentially welded at locations 72 so as to retain inner member 22 concentrically within outer member 20 and retain catalyst 40 within interstitial space 12.

Figure 13:
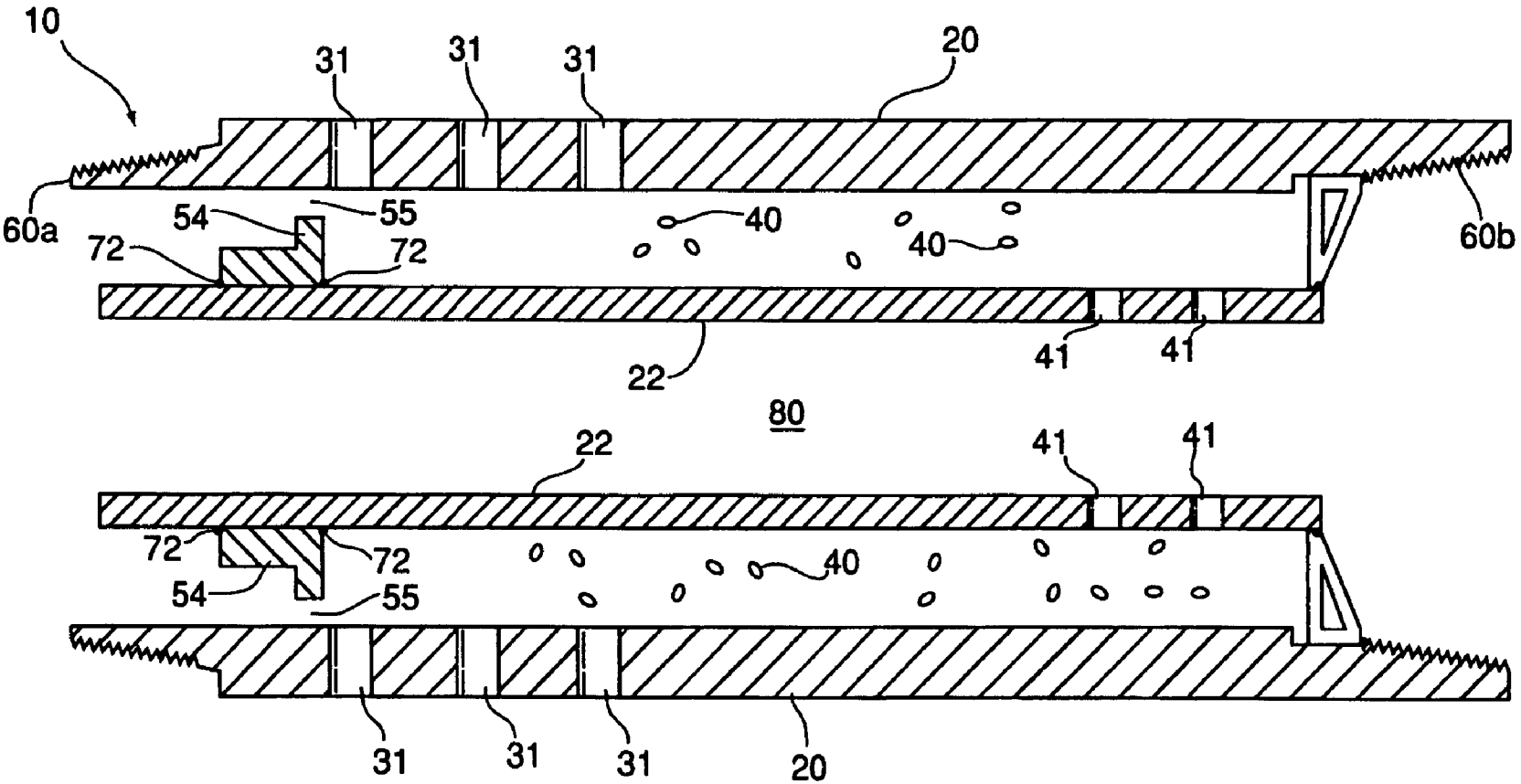
FIG. 13 is a cross-sectional view of a so-called "lateral-flow" well liner, but in comparison to the embodiment shown in FIGS. 10 and 12 shows another variation in the manner by which the inner well liner may be concentrically located within the outer liner member by use of a seal ring.

For manufacture of well liner segments 10 of the configuration shown in FIGS. 12 and 13, the procedure is similar, save that only one seal ring 50 and 54 is respectively welded to the inner 22 or outer liner 20, as the case may be.

For the embodiments of the well liner segments 10 shown in FIGS. 8-11, seal rings 50 and 54 are first circumferentially welded to outer and inner well liner members 20, 22 respectively. Inner well liner 22 is then inserted within outer well liner 20, typically each being aligned in a vertical position, so that seal rings 50, 54 are positioned as shown in the FIGS. 8-11. Locking ring 57 is then inserted as shown in FIGS. 8-11 to secure inner member 22 to outer member 22 at such location. Catalyst pellets 40 are then dropped into the interstitial space 12 via aperture 99 in annular retainer ring 59, so as to fill such space 12 with catalyst 40. Aperture 99 may thereafter, if desired, be sealed by insertion of a plug (not shown) therein.

Although the disclosure describes and illustrates preferred embodiments of the invention, it is to be understood that the invention is not limited to these particular embodiments. Many variations and modifications will now occur to those skilled in the art. For a complete definition of the invention and its intended scope, reference is to be made to the summary of the invention and the appended claims read together with and considered with the disclosure and drawings herein.

I claim:

1. An elongate well liner segment for upgrading hydrocarbons during collection thereof from an underground hydrocarbon reservoir, said liner segment having first and second mutually opposite ends and adapted to be coupled in a horizontal manner at both of said mutually opposite ends to another elongate well liner segment to form an elongate well liner, each well liner segment comprising:

an elongate substantially hollow outer liner member, having a longitudinal axis and possessing a plurality of apertures in at least a portion of a periphery thereof, each of a size sufficient to allow flow therethrough of a flowable hydrocarbon;

an elongate substantially hollow inner liner member, concentrically disposed within an interior of said outer member along said longitudinal axis thereof so as to form an interstitial space between said inner member and said outer member, likewise having a plurality of apertures disposed about periphery thereof to permit ingress of partially upgraded hydrocarbon from said interstitial space to within said inner member;

said interstitial space adapted to be filled with a catalyst to upgrade and improve flowability of said hydrocarbon when said hydrocarbon flows through said interstitial passage and thereafter into said inner member via said apertures therein;

said liner segment having coupling means coupling said inner liner member to said outer liner member; and wherein said coupling means coupling said inner liner member to said outer liner member includes means for allowing longitudinal slidable movement of said inner liner member relative to said outer liner member so as to accommodate differential thermal expansion.

2. The elongate well liner segment as claimed in claim 1, wherein said catalyst is a catalyst selected from the group of catalysts consisting of:

(i) pelletized catalysts; and/or (ii) granularized catalysts wherein such catalyst is of a size sufficient to be substantially be prevented from escaping through any of said apertures in said outer or inner members so as to substantially prevent loss of said catalyst once said catalyst is situated in said interstitial space.

3. The elongate well liner segment as claimed in claim 2, wherein said well line segment contains a catalyst, and said catalyst comprises a hydrocarbon upgrading catalyst.

4. The elongate well liner segment as claimed in claim 3, wherein said hydrocarbon upgrading catalyst is a hydrodesulfurization catalyst.

5. The elongate well liner segment as claimed in claim 2 or 3, wherein:

said apertures in said outer member are situated proximate said first end of said mutually opposite ends; and said apertures in said inner member are situated proximate said opposite second end; and wherein said elongate well liner is adapted via said apertures in said outer member proximate said first end to allow said hydrocarbon to enter said interstitial space and to thereafter travel longitudinally along said well liner segment and within said interstitial space towards said second end while simultaneously contacting said catalyst therein so as to be upgraded, and to thereafter pass into said inner member via apertures in said inner member proximate said second end, so as to become collected in said inner member of said well liner segment.

6. The elongate well liner segment as claimed in claim 2 or 3, wherein said elongate well liner segment is adapted via said apertures in said outer member to allow said hydrocarbon to enter said interstitial space and to thereafter travel radially inwardly within said interstitial space towards said inner member while simultaneously contacting said catalyst therein so as to be upgraded, and to thereafter pass into said inner member via apertures in said inner member so as to become collected in said inner member of said well liner segment.

7. The elongate well liner segment as claimed in claim 1, each of said outer members having first and second mutually opposite ends, wherein said first end of said outer member is adapted to be coupled to said second end of another outer member of another well liner segment.

8. The elongate well liner segment as claimed in claim 1 each of said inner members having first and second mutually opposite ends, wherein said first end of said inner member is adapted to be coupled to said second end of another inner member of another well liner segment.

9. The well liner segment as claimed in claim 1 wherein at least one mutually opposite end of said inner member is adapted to be coupled with an end of an inner member of another well liner segment, and at least one mutually opposite end of said outer member is adapted to be coupled with an end of outer member of another well liner segment.

10. The well liner segment of claim 1, comprising:

(i) at least one seal ring welded to at least one of said inner and outer liner member.

11. The well liner of claim 10, further comprising:

(i) an annular member between said inner and outer liners at an end of each opposite said seal ring, which encapsulates said catalyst pellets within said interstitial space between said inner and outer liner members, and said seal ring and said annular member.

12. The well liner segment as claimed in claim 1, wherein said means coupling said inner liner member to said outer liner member comprises a first ring member fixedly attached to said outer liner member, and contacting said inner liner member in slidable engagement.

13. The well liner segment as claimed in claim 1, wherein said coupling means coupling said inner liner member to said outer liner member comprises a first ring member fixedly attached to said inner liner member, and contacting said outer liner member in slidable engagement.

14. The well liner segment as claimed in claim 1, wherein said coupling means coupling said inner liner member to said outer liner member comprises a first and second pair of ring members situated proximate one end of said well liner segment, said first ring member fixedly coupled to said inner liner member, said second ring member fixedly coupled to said outer liner member, wherein each of said first and second ring members co-operate in a mutual slidable engagement relationship so as to permit longitudinal movement of associated inner and outer liner members relative to each other.

15. An improved in situ process for upgrading hydrocarbons when collecting said hydrocarbons from an underground hydrocarbon reservoir, comprising the steps of:

(i) drilling at least one production well having a substantially horizontal leg and a substantially vertical production well connected thereto, wherein the substantially horizontal leg has a heel portion in the vicinity of its connection to the vertical production well and a toe portion at the opposite end of the horizontal leg, said horizontal leg of said production well being situated in a lower part of said hydrocarbon reservoir;

(ii) coupling together a plurality of elongate well liner segments, each fluidly coupled together so as to form a horizontal well liner, each of said well liner members comprising:

(a) an elongate substantially hollow outer member, having a longitudinal axis and possessing a plurality of apertures in at least a portion of a periphery thereof, each of a size sufficient to allow flow therethrough of a flowable hydrocarbon;

(b) an elongate substantially hollow inner member, concentrically disposed within an interior of said outer member along said longitudinal axis thereof so as to form an interstitial space between said inner member and said outer member, likewise having a plurality of apertures in at least a portion of a periphery thereof to permit ingress of partially upgraded hydrocarbon from said interstitial space to within said inner member;

(c) said interstitial space filled with a catalyst to upgrade and improve flowability of said hydrocarbon when said hydrocarbon flows through said interstitial passage and thereafter into said inner member via said apertures therein;

(d) said liner segment having coupling means coupling said inner liner member to said outer liner member; and (e) wherein said coupling means coupling said inner liner member to said outer liner member includes means for allowing longitudinal slidable movement of said inner liner member relative to said outer liner member so as to accommodate differential thermal expansion;

(iii) inserting said coupled-together well liner segments into said horizontal well bore;

(iv) heating said hydrocarbon formation; and (v) recovering upgraded hydrocarbons which flow into said inner liner member within said horizontal well liner.

16. The process as claimed in claim 15, further comprising the steps of:

(i) drilling at least one injection well for injecting an oxidizing gas into said hydrocarbon reservoir proximate an upper region thereof; and (ii) injecting an oxidizing gas through the injection well; and (iii) said step (iv) of claim 15 of heating said hydrocarbon containing formation comprising initiating in situ combustion in said hydrocarbon-containing formation, so that combustion gases progressively advance as a front through the formation, substantially perpendicular to the horizontal leg, and liquefied hydrocarbon fluids drain into the horizontal well liner within said horizontal leg and into said interstitial space filled with catalyst and contact said catalyst and thereby become upgraded.

* * * * *